US005226623A

United States Patent [19]

Hunt et al.

[11] Patent Number: 5,226,623

[45] Date of Patent: Jul. 13, 1993

[54] PAINT BUCKET HOLDER

[76] Inventors: Rodney J. Hunt; Jeffrey A. Hunt, both of 6025 Pierce St., Omaha, Nebr. 68106

[21] Appl. No.: 897,759

[22] Filed: Jun. 12, 1992

[51] Int. Cl.[5] ..... E06C 7/14

[52] U.S. Cl. ..... 248/211; 182/129

[58] Field of Search ..... 248/211, 210, 227, 304, 248/301, 339; 182/129

[56] References Cited

U.S. PATENT DOCUMENTS

| | | | |
|---|---|---|---|
| 2,522,658 | 9/1950 | Williams | 248/211 |
| 4,580,752 | 4/1986 | Patrick | 248/210 |
| 4,887,785 | 12/1989 | Blaich | 248/304 X |
| 5,062,607 | 11/1991 | Kisner | 248/211 |
| 5,154,383 | 10/1992 | Collinson | 248/211 |

*Primary Examiner*—Ramon O. Ramirez
*Attorney, Agent, or Firm*—George R. Nimmer

[57] ABSTRACT

For usage with conventional bucket-like containers for paints and being conventionally provided with an arcuate, pivotably-attached bail, a paint bucket holder that is reliably removably engageable among selectable, horizontally extending ladder rungs. The paint bucket holder has three components that respectively serially extend along a central vertical-plane. The uppermost component is an easily manually graspable ear component that lies along an upright-web positioned along the vertical-plane, and which ear manual grasping capability preferably takes the form of a horizontally-flanged horizontal-opening for the ear component. The central component is a central-hook-component which includes horizontal-webs extending bi-directionally from the upright-web so as to non-rotatably engage a selectable ladder rung. The lowermost component is a lower-hook component for stably engaging the upwardly extendable pivotal bail of a conventional paint bucket. Preferably, all three components are singularly constructed throughout of a resinous structural material.

8 Claims, 2 Drawing Sheets

PAINT BUCKET HOLDER

BACKGROUND OF THE INVENTION

Wall coating paints are conventionally furnished to the painter in bucket-like containers equipped with an arcuate, pivotably attached bail. For coatably painting lofty walls, the inventor of U.S. Pat. No. 2,522,658, and kindred prior art workers, have attempted to provide paint bucket holders intended reliably removably hang a paint-containing bucket (at its upwardly extended bail) to an elevationally selectable ladder rung. However, prior art paint bucket holders suffer from various disadvantages and deficiencies, including, inter alia: difficulty in easily repositioning the holder from one ladder rung to another; the existence of inimical twisting or rotatability between the paint bucket holder and a ladder rung; vexatious pivotal twisting of the paint bucket bail at the ladderengaged paint bucket holder; and intolerable expense in providing a suitable paint bucket holder.

OBJECT OF THE INVENTION

It is accordingly the general objective of the present invention to provide a paint bucket holder, removably extendable between selectable ladder rungs and the paint bucket bail, which overcomes the disadvantages and deficiencies associated with paint bucket holders taught by the prior art.

GENERAL STATEMENT OF THE INVENTION

With the above general objective in view, and together with other ancillary, related, and specific objectives which will become more apparent as this description proceeds, the paint bucket holder concept of the present invention generally comprises three components that serially lie along a central vertical-plane and including: an upper, ear component predominately defined by an upright-web that extends along said vertical-plane, said ear component being provided with a horizontally extending, manually graspable means that facilitates paint bucket holder movement between selectable ladder rungs; a downwardly-extending centrally-located-hook component that comprises upper-portions of horizontal-webs extending bi-directionally from said upright-web whereby said centrally-located-hook is adapted to non-rotatably (i.e. substantially non-twistably) engage a ladder rung; an upwardly-extending lower-hook component that comprises lower-portions of said horizontal-webs whereby said lower-hook component is adapted to stably (i.e. substantially non-twistably) engage the upwardly extending pivotal bail of a paint bucket container; and preferably, all three components being structurally constructed throughout of a suitable resinous material.

BRIEF DESCRIPTION OF THE DRAWING

In the drawing, wherein like characters refer to like parts in the several views, and in which.

Figure 1:
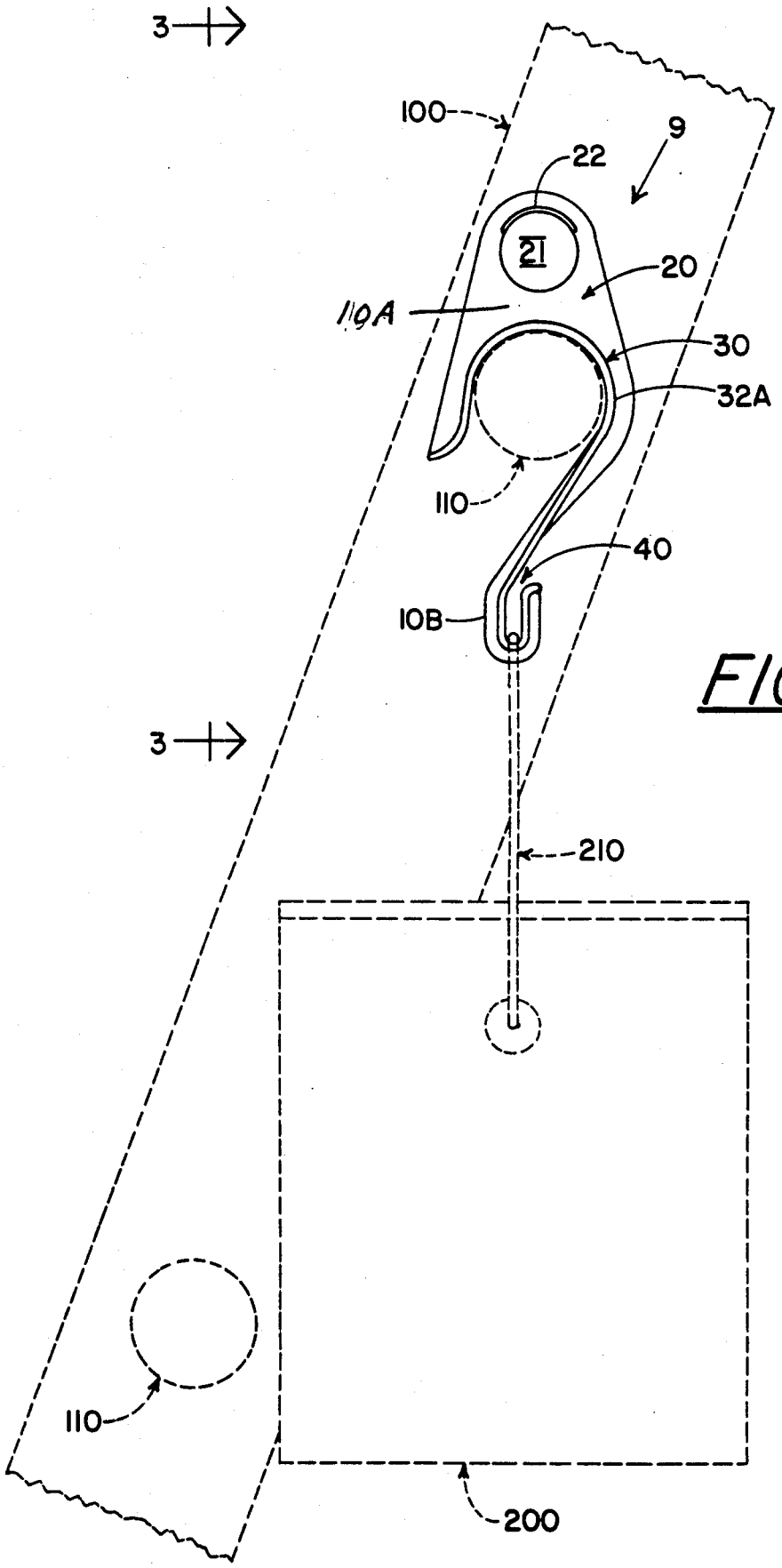
FIG. 1 is a left side elevational view of a representative embodiment (9) of the paint bucket holder of the present invention and shown uprightly removably extending between selectable ladder rung (110) and paint bucket bail (210) environments depicted in phantom lines.
Figure 4:
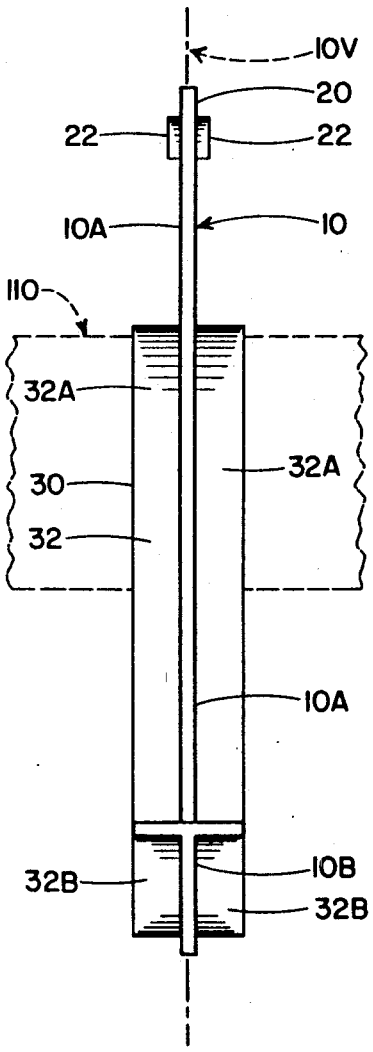
FIG. 4 is a rearward elevational view of embodiment 9.
Figure 2:
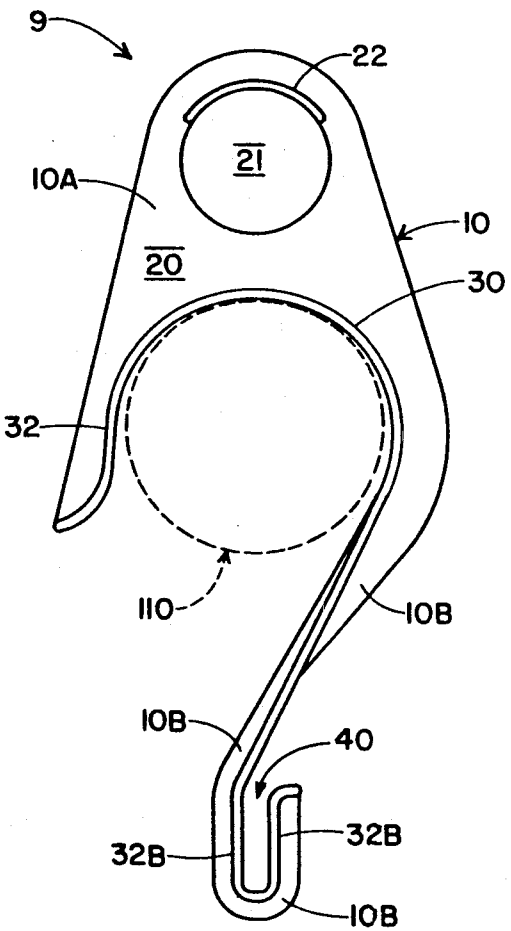
FIG. 2 is an enlarged detail view of the FIG. 1 left side elevational view of embodiment 9, the right side elevational view (not shown) being a mirror image thereof.
Figure 3:
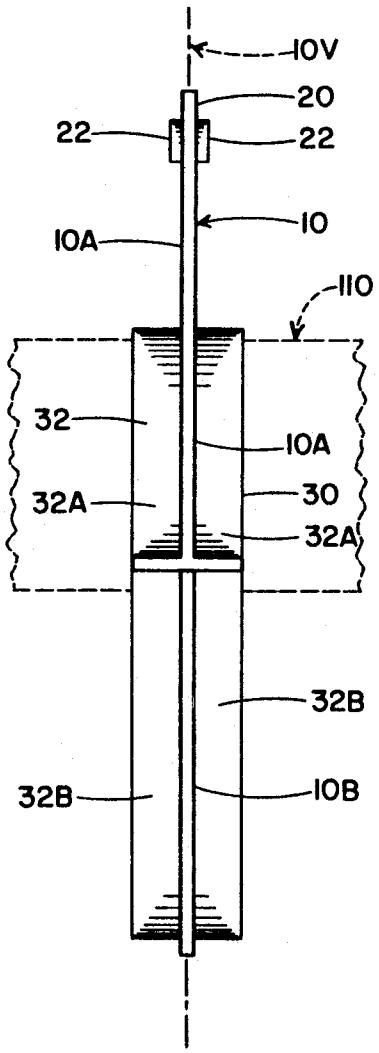
FIG. 3 is a frontal elevational view of embodiment 9, taken along line 3—3 of FIG. 1.

In drawing FIGS. 1–4, solid lines depict paint bucket holder embodiment 9, and phantom lines indicate: a ladder (100) having horizontally extending rungs (110); and a conventional paint-containing bucket (200) having an arcuate, pivotably-attached bail(210).

DETAILED DESCRIPTION OF THE DRAWING

Representative embodiment 9 of the paint bucket holder, for reliable removable engagement (30) to a selectable horizontal ladder rung (110), comprises three components (e.g. 20, 30, 40) that serially uprightly extend along a central vertical-plane 10 V.

There extends along vertical-plane 10 V, an upright-web 10 having an upper-reach 10A and a lower-projection 10B.

There is an upper ear component 20 predominately defined by upright-web upper-reach 10A. Upper ear component 20 is provided with a horizontally extending, manually graspable means (e.g. horizontal-opening 21) that facilitates the holder (and attached paint bucket 200, 210) to be re-positioned for removable engagement (30) to a selectable ladder rung (110). For a such horizontal-opening manual engagement means 21, at least the upper portion thereof can be bi-directionally horizontally flanged (22) from upright-web 10A to facilitate manual grasping and inter-rungs movement.

Below upper ear component 20, there is a downwardly-extending central-hook 30 that comprises upper-portions (32A) of horizontal-webs 32 that bi-directionally extend from upright-web 10. Accordingly, such horizontally-webbed (32A) centrally-located-hook (30) is adapted to non-rotatably (i.e. substantially non-twistably) engage a selectable ladder rung (110).

Vertically below said centrally-located-hook component (30), there is an upwardly-extending lower-hook component 40 that includes lower-portions (32B) of said horizontal-webs 32, whereby said horizontally-webbed (32B) lower-hook component 40 is adapted to stably (i.e. substantially non-twistably) engage the pivotably upwardly-extending bail 210 of a paint bucket receptacle 200. The said horizontally-webbed portion (32A, 32B) at said centrally-located-hook (30) and lower-hook (40) portions are together preferably of S-shaped elevational configuration, the lower-hook portion (40) being constrictably radially smaller than said centrally-located-hook portion. Along said vertical-plane 10V, lower-hook portion 40 is desireably strengthened by lower-projections (10B) of the said upright-web 10.

The entire holder (9) at all components thereof (10, 20, 30, 40) is aptly continuously constructed throughout of the same structural material, and preferably so resinously constructed throughout (e.g. of polypropylene structural material).

From the foregoing, the construction and operation of the paint bucket holder will be readily understood and further explanation is believed to be unnecessary. However, since numerous modifications and changes will readily occur to those skilled in the art, it is not desired to limit the invention to the exact construction shown and described hereabove, and accordingly, all suitable modifications and equivalents may be resorted to, falling within the scope of the appended claims.

What is claimed is as follows:

1. For usage with a paint bucket having a pivotal bail, a paint bucket holder enabling reliable removable engagement to a selectable, horizontally extending ladder rung, said paint bucket holder having three structurally continuous components that respectively lie along a common vertical-plane and including:

(A) an upper, ear component predominately defined by an upright-web that extends along said vertical-plane, said ear component being provided with a horizontally flanged, manually graspable means that facilitates paint bucket holder movement between selectable ladder rungs;

(B) a downwardly-extending central-hook component that comprises upper-portions of horizontal-webs extending bi-directionally from said upright-web whereby said horizontally-webbed centrally-located-hook is adapted to non-rotatably engage a ladder rung; and (C) an upwardly-extending lower-hook component that comprises lower-portions of said horizontal-webs whereby said horizontally-webbed lower-hook component is adapted to stably engage the upwardly extending pivotal bail of a paint bucket.

2. The paint bucket holder of claim 1 wherein said upper ear horizontally extending, manually graspable means comprises a horizontal-opening through said upper ear component.

3. The paint bucket holder of claim 2 wherein at least the upper portion of said upper ear horizontal-opening is horizontally-flanged to facilitate manual grasping through said upper ear ancillary to paint bucket movement between selectable ladder rungs.

4. The paint bucket holder of claim 1 that is continuously constructed throughout of a resinous structural material.

5. The paint bucket holder of claim 1 wherein said upper ear manually graspable means comprises a horizontal-opening through said upper ear component, at least the upper portion of said ear horizontal-opening being horizontally flanged to facilitate manual grasping through said upper ear ancillary to paint bucket movement between selectable ladder rungs.

6. The paint bucket holder of claim 5 wherein said horizontally-webbed portion at said centrally-located-hook and said lower-hook components is of generally S-shaped elevational configuration, said lower-hook component being radially smaller than said centrally-located-hook component and along said vertical-plane being strengthened by lower extensions of said upright-web.

7. For usage with a paint bucket having a pivotal bail, a paint bucket holder enabling reliable removeable engagement to a selectable, horizontally extending ladder rung, said paint bucket holder having three structurally-continuous components that respectively lie along a common vertical-plane and including:

(A) an upper, ear component predominately defined by an upright-web extending along said vertical-plane and being provided with a horizontally flanged, manually graspable means that facilitates paint bucket holder movement between selectable ladder rungs;

(B) a downwardly-extending central-hook component that comprises upper-portions of horizontal-webs extending bi-directionally from said upright-web whereby said horizontally-webbed central-hook is adapted to non-rotatably engage a ladder rung; and (C) an upwardly-extending lower-hook component that comprises lower-portions of said horizontal-webs and is adapted to stably engage the upwardly extending pivotal bail of a paint bucket, and said lower-hook being radially smaller than the said central-hook and, along said vertical-plane, being strengthened by lower extensions of said upright-web.

8. The paint bucket holder of claim 7 wherein said upper ear component is provided with a bi-directionally horizontally flanged horizontal-opening to function as said manually graspable means.

* * * * *